US010961816B1

(12) United States Patent
Church, Jr.

(10) Patent No.: US 10,961,816 B1
(45) Date of Patent: Mar. 30, 2021

(54) OILWELL CHOKE

(71) Applicant: ABSOLUTE CONTROL, LLC, Houston, TX (US)

(72) Inventor: Richard M. Church, Jr., Houston, TX (US)

(73) Assignee: Absolute Control, LLC, Houston, TX (US)

( * ) Notice: Subject to any disclaimer, the term of this patent is extended or adjusted under 35 U.S.C. 154(b) by 0 days.

(21) Appl. No.: 16/747,439

(22) Filed: Jan. 20, 2020

(51) Int. Cl.
*E21B 34/02* (2006.01)

(52) U.S. Cl.
CPC ..... *E21B 34/025* (2020.05)

(58) Field of Classification Search
CPC ..... E21B 34/02; E21B 34/025; E21B 34/04; E21B 34/045
See application file for complete search history.

(56) References Cited

U.S. PATENT DOCUMENTS

| | | | |
|---|---|---|---|
| 2,150,887 | A | 3/1939 | Mueller et al. |
| 2,766,829 | A | 10/1956 | Watts et al. |
| 5,180,173 | A | 1/1993 | Kimura et al. |
| 5,785,075 | A | 7/1998 | Uchida et al. |
| 6,425,413 | B2 | 7/2002 | Davis et al. |
| 7,150,326 | B2 | 12/2006 | Bishop et al. |
| 7,299,880 | B2 | 11/2007 | Logiudice et al. |
| 7,644,772 | B2 | 1/2010 | Avant et al. |
| 8,360,095 | B2 | 1/2013 | Morgan et al. |
| 9,004,091 | B2 | 4/2015 | Joseph et al. |
| 9,181,778 | B2 | 11/2015 | Hurtado et al. |
| 9,624,754 | B2 | 4/2017 | Merron et al. |
| 9,759,347 | B2 | 9/2017 | Elliott |
| 9,879,507 | B2 | 1/2018 | Gilstad et al. |
| 10,094,366 | B2 | 10/2018 | Marica |
| 2012/0223267 | A1* | 9/2012 | Marica ..... F04B 37/14 251/333 |
| 2016/0123099 | A1* | 5/2016 | Kapavarapu ..... E21B 34/02 166/379 |

FOREIGN PATENT DOCUMENTS

| | | | |
|---|---|---|---|
| CN | 108138735 | A | 6/2018 |
| EP | 0567913 | A1 | 7/1995 |
| WO | 2004008009 | A1 | 1/2004 |
| WO | 2015163246 | A1 | 10/2015 |
| WO | 2016073666 | A1 | 5/2016 |

OTHER PUBLICATIONS

Zhanghua et al. "Fluid Field Analysis of High Pressure Throttle Valve and it's Structure Improvement" Phoenics User 2004's International Conference, Australia, (2004); accessed: Nov. 2018.
Wang et al. "Profile Curve Design of Choke Valve Trim of Managed Pressure Drilling" www.cnki.com.cn (2013); accessed: Nov. 2018.

* cited by examiner

*Primary Examiner* — David Carroll
(74) *Attorney, Agent, or Firm* — Mackey Law Firm PLLC

(57) ABSTRACT

An oilwell choke can include a choke body having an inlet and an outlet, a seat, a gate configured to optionally sealingly engage the seat, and an at least partially curved choke profile. A gate can include an at least partially curved gate profile and a seat can include an at least partially curved seat profile. A choke profile can have one or more radiuses of curvature. At least a portion of a choke profile can be elliptical. An oilwell choke can include a secondary closure, which can include an annular tongue configured to sealingly engage an annular groove.

20 Claims, 8 Drawing Sheets

0% Open

5% Open

10% Open

15% Open

20% Open

25% Open

OILWELL CHOKE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The present disclosure relates generally to chokes and more specifically relates to chokes and flow control systems for oil and/or gas wells.

Description of the Related Art

In oilfield drilling and completion operations, chokes, or choke valves, are used to control the flow of high pressure gas and other fluids from pressurized conditions to ambient or otherwise lower pressures for processing. Flow through a choke or valve is often referenced in terms of a flow coefficient (Cv), which is typically a relative measure of the device's efficiency at allowing fluid flow that relates to the pressure drop of fluid travelling through the choke or valve. Conventional choke valves used in drilling and completion activities commonly utilize cylindrically shaped male (gate) and female (seat) choke components which interact to control pressure drop as fluid passes though the seat in the body of the choke. The size of an opening or flow path in the choke can be increased or decreased by changing the position of the gate and seat relative to one another and the flow rate of fluid through the choke can be adjusted or controlled.

Flow control through conventional choke valves can be difficult when the gate and seat are relatively close to one another, such as upon opening of the choke or when the choke is nearing a closed position. For instance, in some conventional designs, the choke can have a relatively flat Cv over some portion of the stroke upon initial gate movement from the seat, such as for approximately the initial 25-30% of the full stroke of the choke, and can exhibit jumps in flow rate upon opening that make control of relatively low flow rates challenging. For example, small changes in the relative positions of the gate and seat can have significant impacts on the resulting flow rates. In at least some cases, choke valves can be categorized by their rangeability, or the range of flow rates over which the chokes can be controlled. Significant increases in flow rate resulting from small changes in gate/seat position when the gate and seat are relatively close to one another can negatively impact a choke valve's rangeability. In addition, the cylindrically shaped gates and seats of conventional choke valves exhibit linear and beveled surfaces that can concentrate erosion and wear in small areas leading to increased wear and damage to the choke control surfaces. Such erosion can have a negative impact on or even result in the loss of the ability to seal and can lead to premature failure of the device.

FIG. 1 is a schematic cross-sectional view of a conventional oilwell choke gate and seat in the closed position. As may be seen from the figure, a conventional choke 10 can have a seat 12 with a cylindrical interior surface 14 and a gate 16 with a cylindrical exterior surface 18 (and possibly a linearly tapered nose for clearance purposes upon entering the seat). At their points of contact A and B, surfaces 14, 18 and the remaining contact surfaces of seat 12 and gate 16 are linear or have a linear contact profile, which can result in one or more of the shortcomings discussed above.

Accordingly, there is a need in the art for improved chokes, such as chokes having greater control capabilities particularly upon initial opening or when in other near-closed positions, chokes having increased wear resistance and chokes having greater sealing capabilities. The disclosures and teachings of the present disclosure are directed to devices, systems and methods for improved chokes for controlling fluid flow for oil and/or gas wells.

BRIEF SUMMARY OF THE INVENTION

In at least one embodiment, a choke for an oil and/or gas well can include a body having one or more inlets for allowing fluid flow into the choke body and one or more outlets for allowing fluid flow out of the choke body, and one or more tubular or other seats disposed within the choke body fluidically between an inlet and an outlet. A seat can have an upstream end fluidically upstream from a downstream end, a radially interior surface and a radially exterior surface. A gate can be disposed at least partially within a choke body and can have a first or other end with a radially exterior surface and a second or other end longitudinally opposite the first or other end. A radially interior surface of a seat can include a first or other seat profile, such as from an upstream end of the seat to a midpoint of a flow path through or otherwise along the seat, and a second or other seat profile, such as from a midpoint of a flow path to a downstream or other end of the seat. A radially exterior surface of a first or other end of the gate can include a first or other gate profile. A gate or a portion thereof can be configured to optionally sealingly engage a seat or a portion thereof. One or more seat and gate profiles or portions thereof can be at least partially curved.

In at least one embodiment, a curved portion of a seat profile and a curved portion of a gate profile can be configured to sealingly couple when the choke is in one or more positions, such as a fully closed position. A first or other seat profile can have a first curved section with a first radius of curvature and a second curved section with a second radius of curvature. A first radius of curvature and a second radius of curvature can be the same or different. A first or other curved section can be fluidically upstream of a second or other curved section. A first or other radius of curvature can be less than, greater than, or equal to, a second or other radius of curvature. In at least one embodiment, an upstream end or other portion of a seat can include a mouth and a first or other seat profile can include a mouth section fluidically upstream of a first or other curved section. A mouth section can extend radially outwardly from a first or other curved section at one or more angles, such as, for example, an angle of 45 degrees relative to a longitudinal center line of the seat. In at least one embodiment, at least a portion of one or more profiles, such as first, second or other seat or gate profiles, can be elliptical.

In at least one embodiment, a first or other curved section can have a fluidically upstream-most end with a first inside diameter and a second curved section can have a fluidically downstream-most end with a second inside diameter, such as at a midpoint or other point of a flow path through a seat. A second inside diameter can be less than a first inside diameter. In at least one embodiment, first and second curved sections can have a constantly changing slope from one reference point or location to another, such as from an upstream-most end of a first curved section to a downstream-most end of a second curved section. In at least one embodiment, a second seat profile can be a mirror image of a first seat profile, such as about a plane bisecting a seat through a midpoint or other point of a flow path.

In at least one embodiment, a first gate profile can have a first curved section with a first radius of curvature and a second curved section with a second radius of curvature. A first radius of curvature and a second radius of curvature can be the same or different. A first curved section can be fluidically downstream from a second curved section and a first radius of curvature can be greater than a second radius of curvature. A first end of a gate can include a nose and a first gate profile can include a nose section fluidically downstream from a first curved section. A nose section can extend radially inwardly from a first or other curved section at one or more angles, such as an angle of 5 degrees relative to a longitudinal center line of a gate. A first end of a gate can include a base and a first gate profile can include a base section fluidically upstream of a second curved section. A base section can extend radially outwardly from a second curved section at one or more angles, such as an angle of 45 degrees relative to a longitudinal center line of a gate. In at least one embodiment, at least a portion of one or more gate profiles can be elliptical.

In at least one embodiment, a first or other curved section can have a fluidically downstream-most end with a first outside diameter and a second or other curved section can have a fluidically upstream-most end with a second outside diameter. A second outside diameter can be greater than a first outside diameter. In at least one embodiment, first and second or other curved sections can have a constantly changing slope over or along at least a portion thereof, such as from a downstream-most end of a first curved section to an upstream-most end of a second curved section. A first gate profile can have a first curved section with a first radius of curvature and a second curved section with a second radius of curvature. A first curved section of a first gate profile can be fluidically downstream from a second curved section of a first gate profile. A first end of a gate can include a base and a first gate profile can include a base section fluidically upstream of a second curved section of a first gate profile. A base section can extend radially outwardly from a second curved section of a first gate profile at one or more angles, such as an angle of 45 degrees relative to a longitudinal center line of the gate.

In at least one embodiment, a choke can include one or more closures or seals, such as first, second, primary, secondary, or other closing structures. In at least one embodiment, a secondary or other closure can include one or more tongues configured to sealingly engage one or more grooves, such as, for example, an annular semicircular tongue configured to sealingly engage an annular semicircular groove. At least one of a tongue and a groove can be disposed on a gate and a seat. For example, one or more of a tongue and a groove can be disposed on a mouth section or other portion of a seat profile and one or more of the other of a tongue and a groove can be disposed on a base section or other portion of a gate profile.

In at least one embodiment, a choke for an oil and/or gas well can include a choke body having an inlet for allowing fluid flow into the choke body and an outlet for allowing fluid flow out of the choke body, a tubular seat disposed within the choke body fluidically between the inlet and the outlet, the seat having an upstream end fluidically upstream from a downstream end, a radially interior surface and a radially exterior surface, and a gate disposed at least partially within the choke body, the gate having a first end with a radially exterior surface and a second end longitudinally opposite the first end. A radially interior surface of the seat can include a first seat profile from the upstream end of the seat to a midpoint of a flow path through the seat and a second seat profile from the midpoint of the flow path to the downstream end of the seat. A radially exterior surface of the first end of the gate can include a first gate profile. A seat profile can have a first curved section with a first radius of curvature fluidically upstream of a second curved section with a second radius of curvature. A gate profile can have a first curved section with a first radius of curvature fluidically downstream from a second curved section with a second radius of curvature. A first curved section of a seat profile can be configured to at least partially engage a second curved section of a gate profile. A second curved section of a seat profile can be configured to at least partially engage a first curved section of a gate profile, such as when a choke is in a fully closed position or one or more other positions.

In at least one embodiment, an upstream end of a seat can include a mouth and a first seat profile can include a mouth section fluidically upstream of a first or other curved section. A mouth section can extend radially outwardly from a first curved section of a first seat profile at one or more angles. A first end of a gate can include a base and a first gate profile can include a base section fluidically upstream of a second curved section. A base section can extend radially outwardly from a second curved section of a first gate profile at one or more angles. A mouth section can be configured to at least partially engage a base section, or vice versa, when the choke is in one or more positions, such as a fully closed position or one or more other positions. In at least one embodiment, a choke can include a secondary or other closure comprising a tongue and groove configured to at least partially engage one another. For example, in at least one embodiment, a choke can include an annular semicircular tongue configured to sealingly engage an annular semicircular groove. One of the tongue and the groove can be disposed on a seat profile and the other of the tongue and the groove can be disposed on a gate profile. One or more tongues and/or grooves can be disposed on a seat and/or gate.

DETAILED DESCRIPTION

Figure 1:
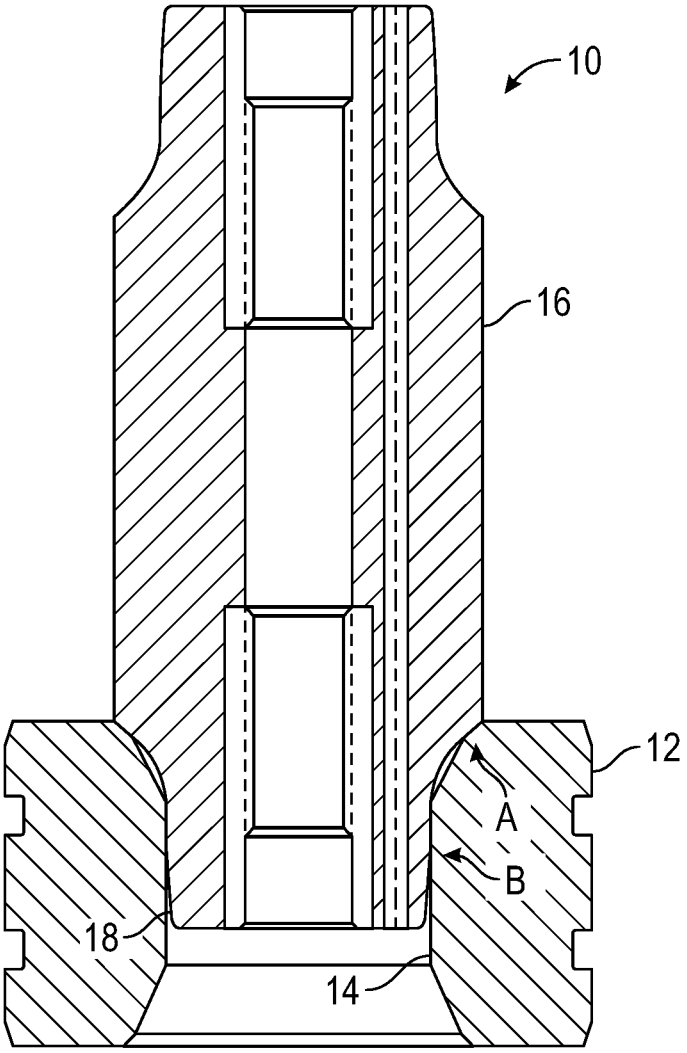
FIG. 1 (Prior Art)
FIG. 1 is a schematic cross-sectional view of a conventional oilwell choke gate and seat in the closed position.

The Figures described above and the written description of specific structures and functions below are not presented to limit the scope of what Applicant has invented or the scope of the appended claims. Rather, the Figures and written description are provided to teach any person skilled in the art to make and use the invention(s) for which patent protection is sought. Those skilled in the art will appreciate that not all features of a commercial embodiment of the disclosure are described or shown for the sake of clarity and understanding. Persons of skill in this art will also appreciate that the development of an actual commercial embodiment incorporating aspects of the present disclosure can require numerous implementation-specific decisions to achieve the developer's ultimate goal for the commercial embodiment(s). Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in the art having the benefits of this disclosure. It must be understood that the embodiment(s) disclosed and taught herein are susceptible to numerous and various modifications and alternative forms. The use of a singular term, such as, but not limited to, "a," is not intended as limiting of the number of items. The use of relational terms, such as, but not limited to, "top," "bottom," "left," "right," "upper," "lower," "down," "up," "side," "first," "second," ("third" et seq.), "inlet," "outlet" and the like are used in the written description for clarity in specific reference to the Figures and are not intended to limit the scope of the disclosure or the appended claims unless otherwise indicated. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one member with another in a unity fashion. The coupling can occur in any direction, including rotationally. The terms "include" and "such as" are illustrative and not limitative, and the word "can" means "can, but need not" unless otherwise indicated. Notwithstanding any other language in the present disclosure, the embodiment(s) shown in the drawings are examples presented for purposes of illustration and explanation and are not the only embodiments of the subject(s) hereof.

Applicant has created systems and methods for improved oilwell chokes having greater flow control capabilities, including upon initial opening and when in other near-closed or low flow positions. Embodiments of the disclosure can provide precise flow metering and positive closure in extreme service conditions, which can include operation up to at least 20,000 psi (138 MPa) working pressure. Applicant has created systems and methods for improved chokes having improved capabilities for resisting wear. Applicant has created systems and methods for improved chokes having improved sealing capabilities, which can include redundant or supplemental sealing capabilities. In at least one embodiment, a choke can include a gate and a seat having at least partially curved choke surfaces. In at least one embodiment, a choke can include a gate and a seat having supplemental sealing structure, such as a secondary or other closure for at least partially supporting sealing engagement between portions of the gate and seat. One or more aspects and embodiments of the disclosure are described in further detail below with reference to the figures.

Figure 2:
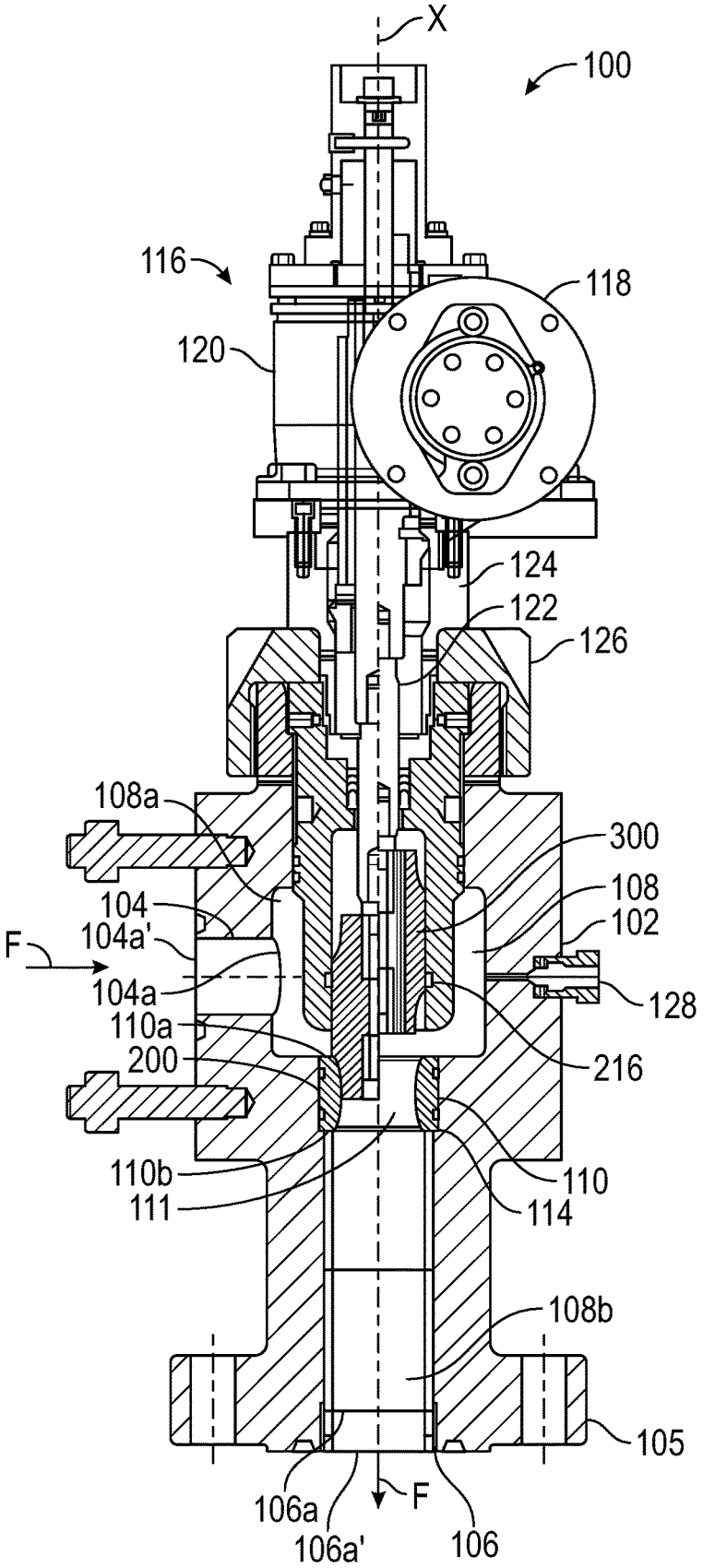
FIG. 2 is a split cross-sectional view of one of many embodiments of an oilwell choke according to the disclosure.
Figure 3:
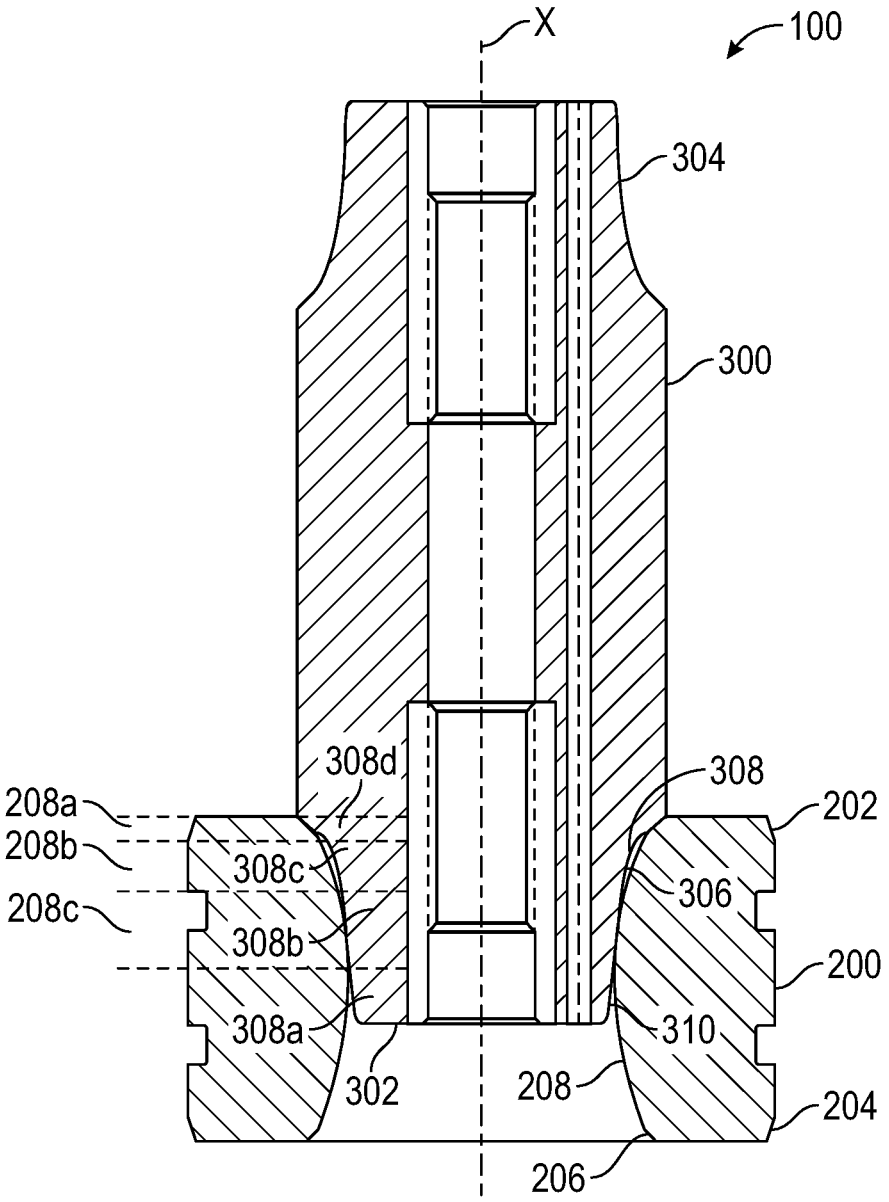
FIG. 3 is a schematic cross-sectional view of some of many embodiments of an oilwell choke gate and seat according to the disclosure.
Figure 4:
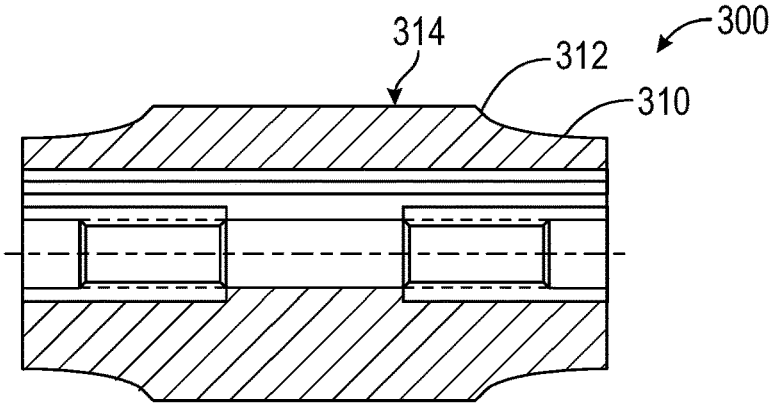
FIG. 4 is a cross-sectional side view of one of many embodiments of an oilwell choke gate according to the disclosure.
Figure 5:
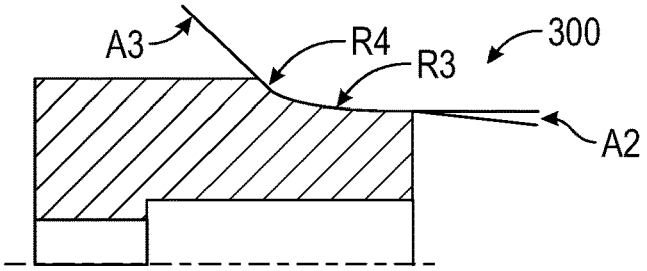
FIG. 5 is a detail view of a portion of FIG. 4.
Figure 6:
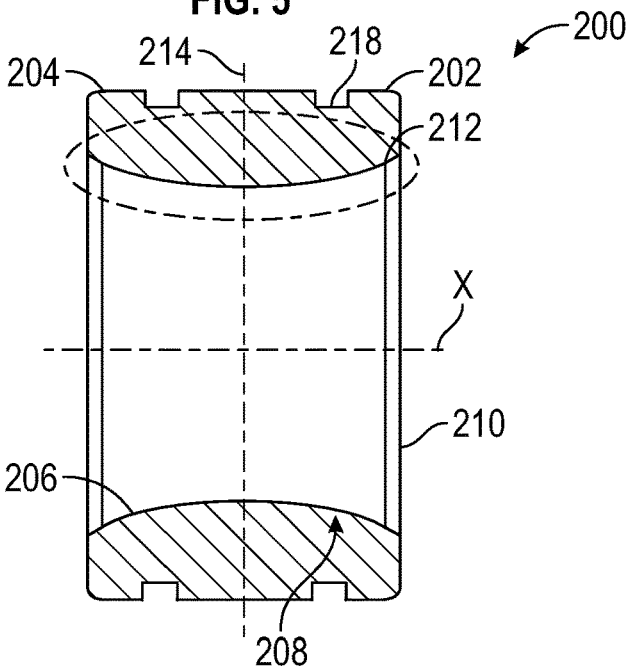
FIG. 6 is a cross-sectional side view of one of many embodiments of an oilwell choke seat according to the disclosure.
Figure 7:
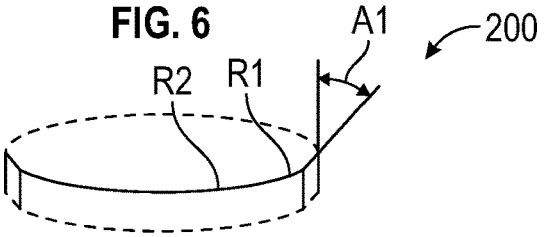
FIG. 7 is a detail view of a portion of FIG. 6.
Figure 8:
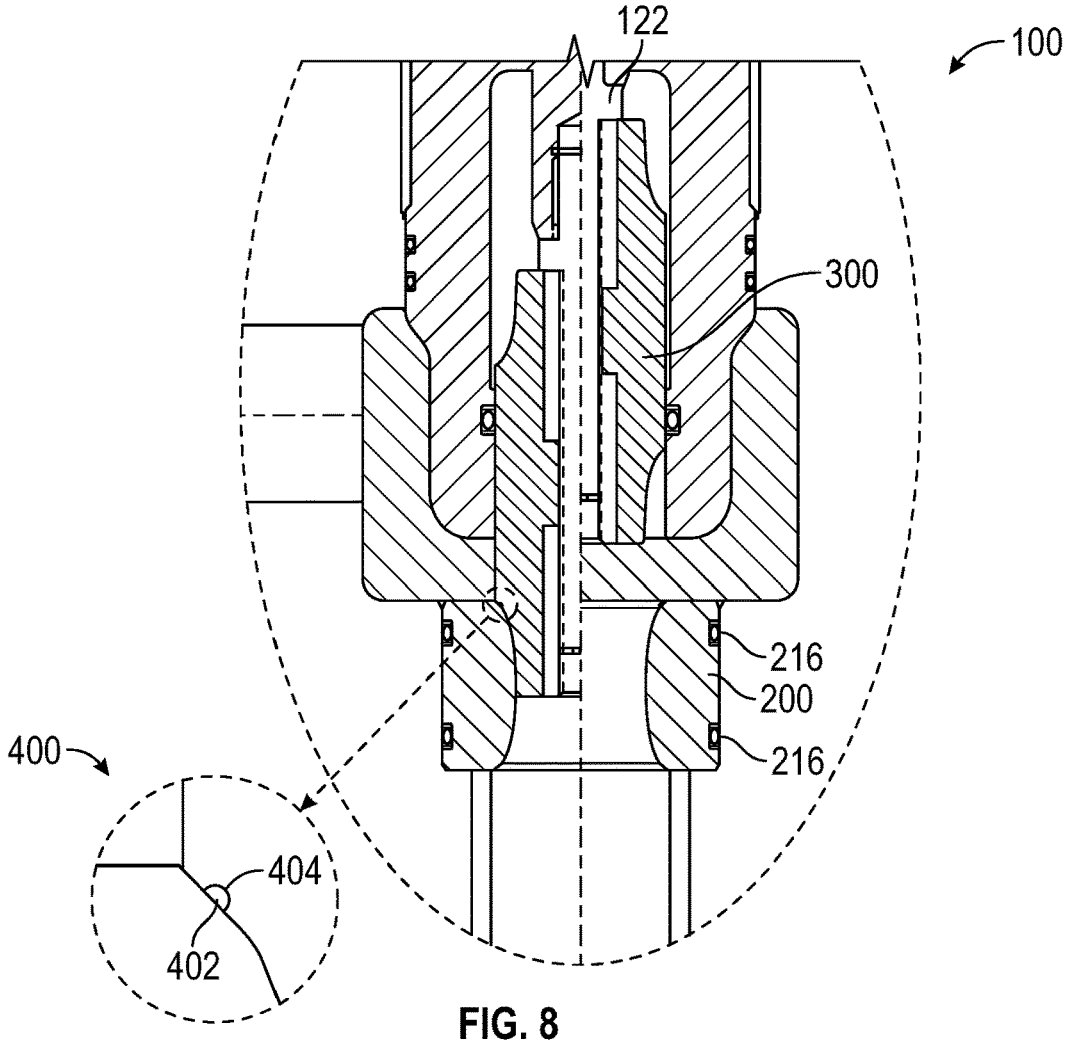
FIG. 8 is a split cross-sectional view of another of many embodiments of an oilwell choke according to the disclosure.
Figure 9:
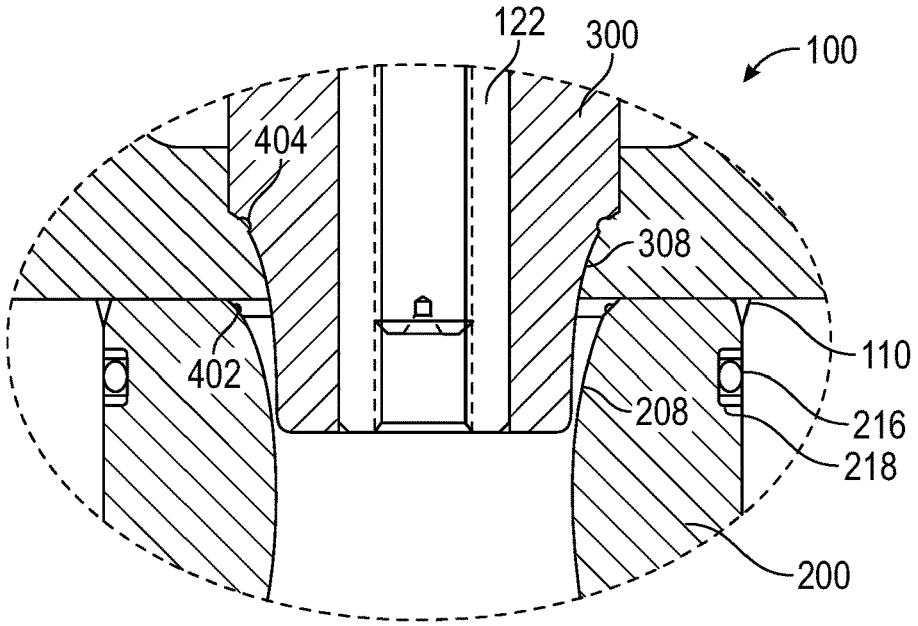
FIG. 9 is a detail view of a portion of the embodiment of FIG. 8 in a partially open position.
Figure 10A:
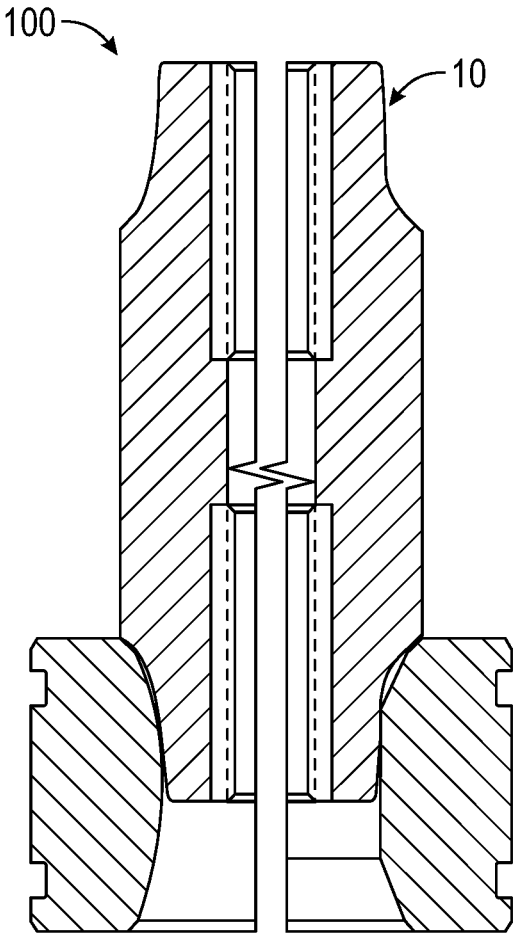
FIGS. 10A-10F are split cross-sectional views comparing one of many embodiments of an oilwell choke according to the disclosure to a conventional choke over a range of open positions.
Figure 10B:
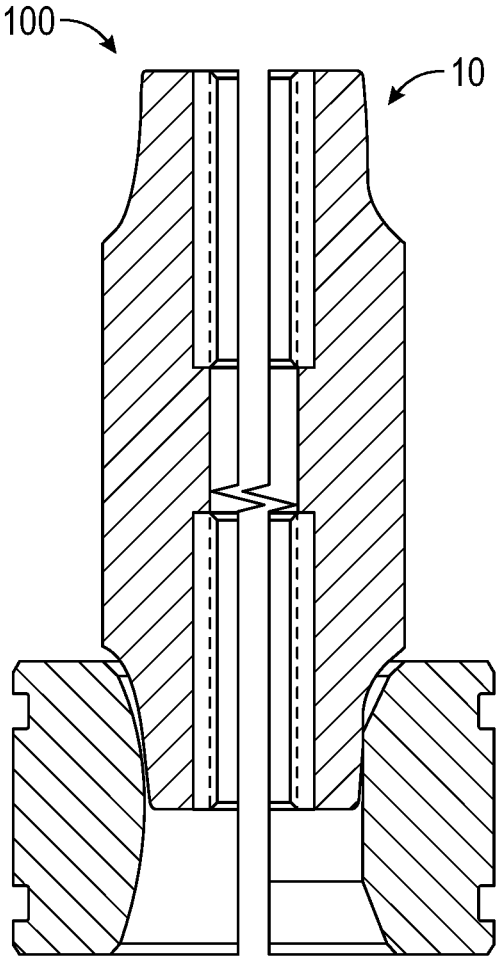
Figure 10C:
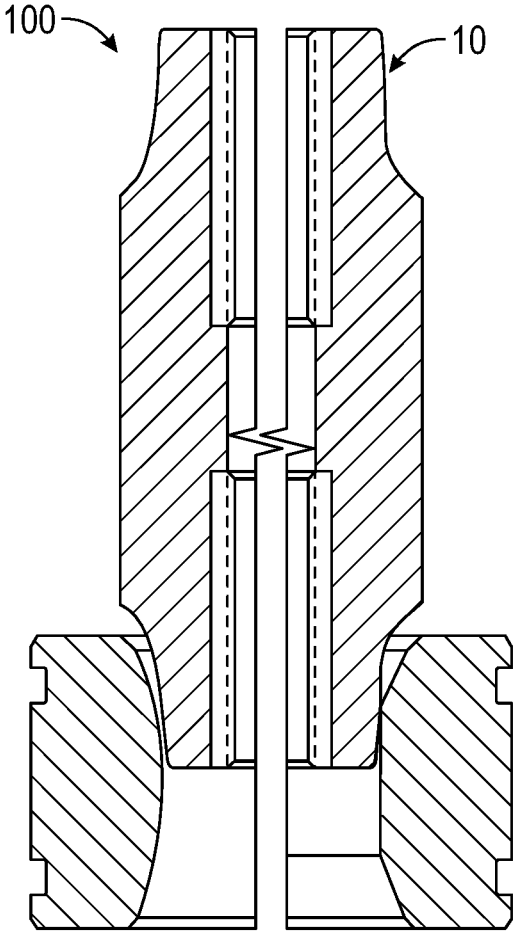
Figure 10D:
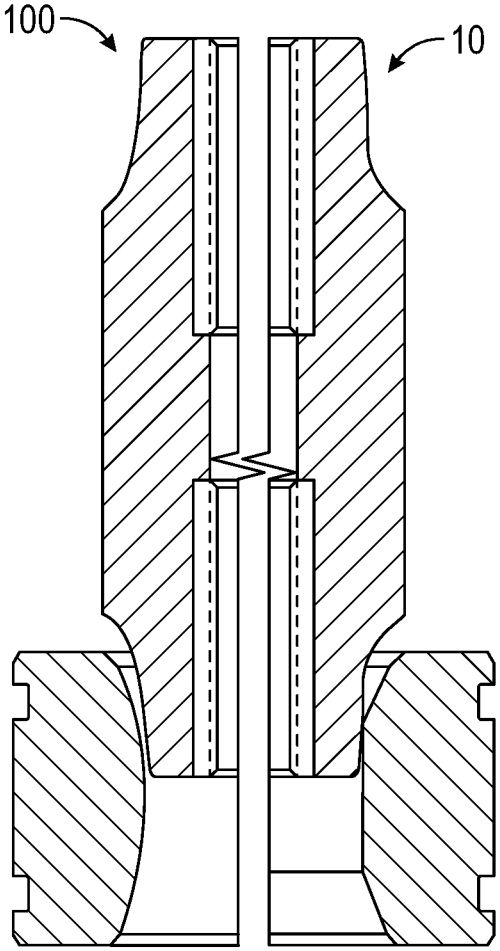
Figure 10E:
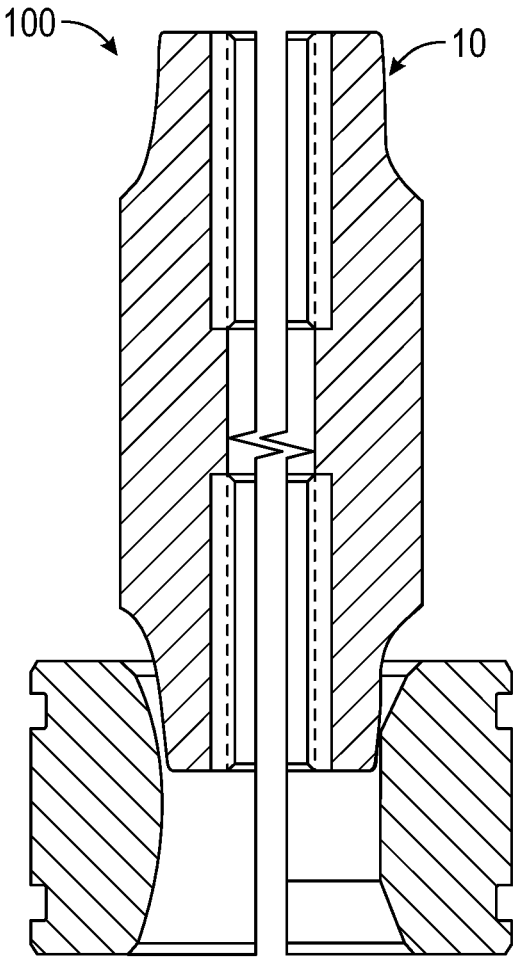
Figure 10F:
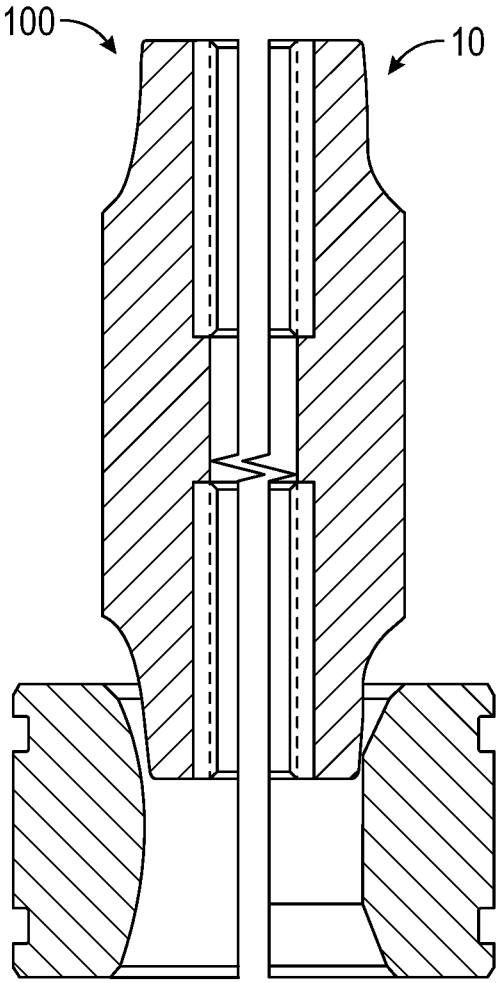

FIG. 2 is a split cross-sectional view of one of many embodiments of an oilwell choke according to the disclosure. FIG. 3 is a schematic cross-sectional view of some of many embodiments of an oilwell choke gate and seat according to the disclosure. FIG. 4 is a cross-sectional side view of one of many embodiments of an oilwell choke gate according to the disclosure. FIG. 5 is a detail view of a portion of FIG. 4. FIG. 6 is a cross-sectional side view of one of many embodiments of an oilwell choke seat according to the disclosure. FIG. 7 is a detail view of a portion of FIG. 6. FIG. 8 is a split cross-sectional view of another of many embodiments of an oilwell choke according to the disclosure. FIG. 9 is a detail view of a portion of the embodiment of FIG. 8 in a partially open position. FIGS. 10A-10F are split cross-sectional views comparing one of many embodiments of an oilwell choke according to the disclosure to a conventional choke over a range of open positions. FIGS. 2-10F will be described in conjunction with one another.

In at least one embodiment, an oilwell choke 100 for controlling the flow of fluid(s) from the wellbore of an oil and/or gas well (collectively, "oil well") can include a choke body 102, such as a casing, enclosure, or housing, for enclosing, protecting or otherwise supporting one or more other choke components, and can include one or more inlets 104 for fluid flow into the choke and one or more outlets 106 for fluid flow out of the choke. Choke body 102 can be or include a single, unitary body or can include a plurality of choke body portions coupled together. Choke body 102 can be formed in any shape or manner according to an implementation of the disclosure and choke 100 can include any number of bodies 102 or body portions according to a particular implementation, any of which can be coupled with one another in any applicable fashion, which can, but need not, include the use of one or more couplers for coupling two or more choke components together, such as male couplers, female couplers, fasteners, receivers, adhesives or other coupling structure(s), separately or in combination. Inlet 104 can include a plurality of inlet components or other inlet portions coupled or otherwise disposed in fluid communication. For example, inlet 104 can include one or more inlet openings, such as an opening 104*a* in an inside surface and an opening 104*a*' in an outside surface of body 102, for allowing fluid flow in one or more directions between the inside and outside of body 102. Openings 104*a*, 104*a*' can have the same or different cross-sectional shapes and/or dimensions, which can be any shape(s) and dimension(s) according to a particular implementation of the disclosure. Inlet 104 can include or be configured to couple with an inlet conduit (not shown) for routing fluid or otherwise allowing fluid to move there through, such as from a location outside of choke 100 to or through inlet opening(s) 104*a*. Inlet 104 can be configured to couple with other structure in a choke or fluid system, such as pipes, tubing, hoses, fluid sources, fluid receivers, fluid destinations or other conduits or components, which can be or include a separate coupler or an integral coupler portion, in whole or in part. For example, choke 100 can be configured to couple with one or more other components of a fluid system threadedly, by sweating, brazing or welding, by compression fitting, or otherwise, and can be or include any type of fastener, fitting or other coupler (e.g., flanged or studded end connections) now known or future developed, separately or in combination with one another. For instance, as shown for illustrative purposes in the exemplary embodiment of FIG. 2, which is but one of many, choke 100 can include one or more flanges 105 for coupling to one or more other choke system components, such as by way of one or more bolts or other fasteners coupled to flange 105 (see, e.g., the studded end connection of inlet 104). The foregoing description regarding inlet 104 can apply similarly to one or more other inlets, outlets or other fluid ways of choke 100. For example, outlet 106 can include one or more outlet openings 106*a*, 106*a*' and/or one or more outlet conduits or outlet couplers. Alternatively, one or more of these components can be absent, as appropriate in accordance with a particular implementation of the disclosure.

Choke 100 can include one or more flow passages 108, such as a choke flow passage, fluid route or other flow path, for routing or otherwise directing fluid through the choke from inlet 104 to outlet 106 (or vice versa). Each flow passage 108 can include, or at least can be described to include for ease of illustration and explanation, two or more sub-flow passages (or component flow passages) that collectively make up the corresponding flow passage 108 through the choke. For example, in at least one embodiment, flow passage 108 can include one or more first passages 108*a*, such as an inlet or other flow passage, from inlet 104 to a location along passage 108 and one or more second flow passages 108*b*, such as an outlet or other flow passage, from such location to outlet 106. Choke 100 can further include one or more other component flow passages separately or in combination with one another and/or any of first and second flow passages 108*a*, 108*b*. Further, each component flow passage can, but need not, comprise a plurality of passages or other paths between two or more points along flow passage 108.

Choke 100 can include one or more orifices 110, such as an opening, conduit or other passageway, for at least partially restricting or otherwise affecting flow through the choke. Orifice 110 can be disposed at least partially within flow passage 108, such as fluidicly between inlet 104 and outlet 106. Orifice 110 can be disposed at least partially within body 102 and can include a plurality of openings or other flow paths for defining a portion of one or more flow passages of choke 100, such as, for example, an orifice flow passage forming a part of flow passage 108. Orifice 110 can include one or more orifice inlets 110*a* for allowing fluid to enter the orifice and one or more orifice outlets 110*b* for allowing fluid to exit the orifice. Orifice 110 can be adapted for coupling with, receiving, or otherwise cooperating with at least a portion of one or more seats 200 according to the disclosure (further described below), which can, but need not, include having one or more shoulders 114 for limiting movement of seat 200 in one or more directions.

Choke 100 can include an actuator assembly 116, such as a manual or non-manual actuator assembly, for controlling fluid flow through at least a portion of choke 100, separately or in cooperation with one or more other choke components. Actuator assembly 116 can be adapted to couple to one or more other choke components, such as choke body 102 or a component coupled to choke body 102, directly or indirectly, in whole or in part. In at least one embodiment, actuator assembly 116 can include an actuator 118 and a housing 120, such as an at least partial enclosure, for holding or otherwise supporting one or more components of actuator assembly 116 and/or other choke components. Actuator 118 can be adapted for moving, retaining or otherwise holding one or more gates 300 (further described below) to, from or in one or more positions. Gate 300 (or choke 100) can have any number of positions according to a particular application and actuator 118 can be adapted for moving gate 300 among such positions. For example, gate 300 can have a fully closed position for maximizing resistance to flow through at least a portion of choke 100, which can include preventing flow there through. As another example, gate 300 can have a fully open position for minimizing resistance to flow through at least a portion of choke 100, such as by minimizing flow resistance caused by gate 300 or a portion thereof. Gate 300 can have one or more partially open (or partially closed) positions between the fully open and fully closed positions for allowing fluid flow at one or more rates between a maximum and a minimum flow rate, which can be any flow rate(s) according to an embodiment or implementation at hand. As shown in the exemplary embodiment of FIG. 2 for illustrative purposes, which embodiment is but one of many, actuator 118 can be or include a hydraulic gear operated actuator. However, this need not be the case and actuator 118 can alternatively, or collectively, be or include one or more other types of actuators, which can be or include any type of solenoid actuator(s) according to an implementation of the disclosure, whether now known or later developed. For example, in at least one embodiment, actuator 118 can be or include a worm gear operated actuator or, as another example, a manual actuator comprising a wheel, lever, or other actuator member for converting, e.g., rotational or other input motion to linear or other output motion. In at least one embodiment, at least a portion of actuator assembly 116, such as actuator 118 and/or one or more other actuation components (e.g., operator body 124), can be movably coupled to choke body 102 for supporting positioning or repositioning of one or more components of choke 100 during choke operations. For example, actuator assembly 116 or a portion thereof exposed to the fluid cavity of choke 100 can be coupled to choke body 102 with a coupler 126, such as a nut or acme threaded nut, for supporting rotation of actuator assembly 116 or a portion thereof exposed to the fluid cavity of choke 100 relative to choke body 102, including but not limited to supporting such rotation without any need to change a position of actuator 118. In this manner, actuator assembly 116 or a portion thereof exposed to the fluid cavity of choke 100 can be rotated periodically or otherwise to more evenly or effectively distribute flow wear within or among one or more components of choke 100. In at least one embodiment, coupler 126 can be configured for relieving internal pressure prior to removal from choke body 102, whether separately or in combination with one or more other components of choke 100, such as relief valve 128.

Actuator 118 can be or include structure for holding one or more gates 300 in one or more positions and for moving such gate(s) among positions. For example, actuator 118 can include actuator linkage 122, such as one or more actuator arms or other members, for coupling with gate 300, removably, permanently, or otherwise. Actuator 118 can move gate 300 among or between two or more wholly or partially opened or closed positions with respect to orifice 110 or one or more flow paths in fluid communication with orifice 110. For example, choke 100 can include one or more seats 200 for operatively communicating with one or more gates 300 to choke flow through choke 100, which can include optionally coupling with a corresponding gate 300. Seat 200 can, but need not, be a portion of orifice 110 (e.g., of orifice inlet 110*a*) and/or choke body 102, in whole or in part. In at least one embodiment, seat 200 can be removably coupled with orifice 110, such as by being slidingly and sealingly coupled therewith (see, e.g., FIG. 2). In at least one embodiment, seat 200 can include one or more seals 216 for coupling with orifice 110 or an interior surface thereof, which can optionally be disposed in one or more seal grooves 218 of seat 200, such as on a radially exterior surface or other portion thereof. Seat 200 and gate 300 can but need not be configured to sealingly couple with one another for preventing or otherwise limiting fluid flow through one or more portions of flow passage 108, such as through orifice flow passage 111, in whole or in part. For instance, in at least one embodiment, choke 100 can have a fully closed position wherein gate 300 and seat 200 are sealingly engaged for preventing flow into and/or through orifice 110 and one or more open positions wherein gate 300 and seat 200 are not sealingly engaged and, rather, are disposed relative to one another (e.g., longitudinally along axis X) for allowing fluid flow. As shown in the split views of FIGS. 2 and 8 for illustrative purposes, gate 300 is shown in a closed position on the left side of the figures and gate 300 is shown in an open position on the right sides of the figures. As another example, FIG. 9 illustrates one of many embodiments of a gate according to the disclosure in a partially open (or partially closed) position.

As seen for example in FIGS. 3-8, seat 200 and gate 300 can have complementary choke or flow control surfaces for routing or choking fluid flow within or through choke 100 in one or more partially open or partially closed positions. For example, seat 200 can have a first end 202, a second end 204 and one or more radially interior surfaces 206 and gate 300 can have a first end 302, a second end 304 and one or more radially exterior surfaces 306. One or more radially interior surfaces 206 (and/or other surfaces) of seat 200 can collectively make up a seat profile 208 and one or more radially exterior surfaces 306 of gate 300 can collectively make up a gate profile 308. A seat profile 208 can optionally include one or more surfaces (e.g., in a sealing section) for sealingly engaging at least a portion of a corresponding gate profile 308 (e.g., a corresponding sealing section) in one or more closed choke positions. In at least one embodiment, seat 200 can have a plurality of seat profiles 208, such as a first seat profile 208 on first end 202 and a second seat profile 208 on second end 204. Two or more seat profiles 208 can be the same or different as needed or desired according to a particular implementation of the disclosure. Further, in at least one embodiment, two or more seat profiles 208 can be mirror images of one another (see, e.g., FIG. 6), but that need not be the case and two or more seat profiles 208 can be spaced or otherwise located on seat 200 in any manner according to an implementation of the disclosure. In at least one embodiment, gate 300 can have a plurality of gate profiles 308, such as a first gate profile 308 on first end 302 and a second gate profile 308 on second end 304. Two or more gate profiles 308 can be the same or different as needed or desired according to a particular implementation of the disclosure. Further, in at least one embodiment, two or more gate profiles 308 can be mirror images of one another (see, e.g., FIG. 4), but that need not be the case and two or more gate profiles 308 can be spaced or otherwise located on gate 300 in any manner according to an implementation of the disclosure. In at least one embodiment, one or both of seat 200 and gate 300 can be reversible relative to choke body 102, such as for allowing the utilization of both profiled ends for choke operations prior to the need for replacement of such components due to, e.g., wear on the choke surfaces or sealing surfaces owing to contact with well fluid during choke operations.

In at least one embodiment, seat profile 208 can include a plurality of sections, such as a first or mouth section 208*a* from mouth 210 of seat 200 to another point along seat profile 208, such as a change in shape 212, and one or more other sections from section 208*a* to another point or points along seat profile 208, such as, for example, one or more of a second section 208*b* and a third section 208*c* (and/or one or more additional sections 208*d* . . . 208*n*) from first section 208*a* to midpoint 214 (if present) of seat 200 or another point along the length of seat 200. Mouth section 208*a* can be or include a sealing section for sealingly coupling with gate 300 or a portion thereof. One or more other sections 208*a* . . . 208*n* of seat profile 208 can be or include a choke section for cooperating with gate 300 or a portion thereof to limit, restrict, direct, route, smooth, or otherwise choke fluid flow through choke 100, such as when choke 100 is in one or more at least partially open positions. In at least one embodiment, at least a portion of one or more seat profiles 208 can be curved, which can include being ellipsoidal, elliptical, ovoid, oval, sloped, arcuate, or otherwise nonlinearly shaped, separately or in combination, in whole or in part. In at least one embodiment, seat profile 208 or one or more portions thereof, such as two or more of first section 208*a*, second section 208*b* and third section 208*c*, can have different shapes, shapes of curvature, degrees of curvature, or radiuses of curvature, separately or in combination, in whole or in part. For instance, second section 208*b* can have a radius R1 and third section 208*c* can have a radius R2, which radiuses can be the same or different from one another or one or more other radiuses of profile 208. As other examples, in at least one embodiment, one or more portions of seat profile 208 can be linear or otherwise noncurved, and/or can be disposed at one or more angles relative to one or more reference points or positions. For instance, as illustrated in the exemplary embodiment of FIGS. 6 and 7 for illustrative purposes, at least a portion of first section 208*a* can be disposed at an angle A1 relative to a central longitudinal axis X of choke 100 or seat 200.

In at least one embodiment, gate profile 308 can include a plurality of sections, such as a first or nose section 308*a* from nose 310 of gate 300 to another point along gate profile 308, such as a change in shape 312, and one or more other sections from section 308*a* to another point or points along gate profile 308, such as, for example, one or more of a second section 308*b*, a third section 308*c* and a fourth section 308*d* (and/or one or more additional sections 308*e* . . . 308*n*) from first section 308*a* to exterior surface 314 (if present) of gate 300 or another point along the length of gate 300. Fourth section 308*d* (and/or one or more additional sections 308*e* . . . 308*n*, if present) can be or include a sealing section for sealingly coupling with seat 200 or a portion thereof. One or more other sections, such as one or more of sections 308*a* . . . 308*c* (or others) of gate profile 308 can be or include a choke section for cooperating with seat 200 or a portion thereof to limit, restrict, direct, route, smooth, or otherwise choke fluid flow through choke 100, such as when choke 100 is in one or more at least partially open positions. In at least one embodiment, at least a portion of one or more gate profiles 308 can be curved, which can include being ellipsoidal, elliptical, ovoid, oval, sloped, arcuate, or otherwise nonlinearly shaped, separately or in combination, in whole or in part. In at least one embodiment, gate profile 308 or one or more portions thereof, such as two or more of first section 308*a*, second section 308*b*, third section 308*c* and fourth section 308*d*, can have different shapes, shapes of curvature, degrees of curvature, or radiuses of curvature, separately or in combination, in whole or in part. For instance, second section 308*b* can have a radius R3 and third section 308*c* can have a radius R4, which radiuses can be the same or different from one another or one or more other radiuses of profile 308 or another portion of choke 100, such as radiuses R1 and/or R2 of seat profile 208. As other examples, in at least one embodiment, one or more portions of gate profile 308 (e.g., section 308*d*) can be linear or otherwise noncurved, and/or can be disposed at one or more angles relative to one or more reference points or positions. For instance, as illustrated in the exemplary embodiment of FIGS. 4 and 5 for illustrative purposes, at least a portion of first section 308*a* can be disposed at an angle A2 relative to a central longitudinal axis X of choke 100 or gate 300 and at least a portion of fourth section 308*d* can be disposed at an angle A3 relative to a central longitudinal axis X of choke 100 or gate 300. One or more of sections 308*a*, 308*b*, etc. of gate profile 308 can be adapted for choking cooperation with one or more portions of a corresponding seat profile 208, separately or in combination, in whole or in part.

In at least one embodiment, one or more of sections 208*a*, 208*b*, etc., of seat profile 208 can be adapted to couple with one or more portions of a corresponding gate profile 308, separately or in combination, in whole or in part. One or more of sections 308*a*, 308*b*, etc., of gate profile 308 can be adapted to couple with one or more portions of a corresponding seat profile 208, separately or in combination, in whole or in part. For example, section 208*a* of seat profile 208 and section 308*d* of gate profile 308 can be configured to sealingly engage one another in a fully closed position of choke 100 for halting or preventing fluid flow through the choke. In such a position, the remainder of seat and gate profiles 208, 308 can but need not be in sealing engagement or otherwise in contact with one another, in whole or in part. For example, in at least one embodiment, profile sections 208*a*, 308*d* can be or include sealing surfaces (e.g., linear angled mating surfaces) for sealingly engaging one another in a fully closed position and one or more of the remaining sections (e.g., seat profile sections 208*b*, 208*c* and gate profile sections 308*a*, 308*b*, 308*c*) can be or include choke sections or surfaces for choking fluid flow through choke 100 in one or more open positions but which need not sealingly engage or otherwise contact one another when choke 100 is fully closed (i.e., when profile sections 208*a*, 308*d* are sealingly engaged). Mating portions of the respective profiles 208, 308, such as sealing sections for sealingly engaging in one or more choke positions and/or choke sections for choking cooperation with one another in one or more choke positions, can but need not be of the same size and shape, in whole or in part, such as by way of being substantially or approximately the same size and shape or, said another way, by having a size and/or shape similar enough to accomplish the goals of a given implementation of the disclosure at hand, such as, but not limited to, attaining sealing engagement in a fully closed choke position or another choke position involving sealing engagement of mating seat and gate surfaces or portions thereof (i.e., regardless of whether the choke path as a whole is fully closed). One or more of seat 200 and gate 300 (and/or other components of choke 100) can be formed from any material according to an implementation of the disclosure, including, e.g., steel, tungsten carbide or cobalt tungsten carbide, in whole or in part. In at least one embodiment, the inside diameters of profile sections 208*b*-208*c* of a seat profile 208 can be greater than the outside diameters of the cooperating profile sections 308*a*-308*c* of a gate profile 308 along the entire lengths of the choke surface portions of the respective profiles, for example, such that the choke surfaces do not contact one another when choke 100 is in a fully closed position. However, this need not the case and, in at least one embodiment, at least a portion of the respective choke profiles of seat 200 and gate 300 can contact one another in one or more positions of choke 100, which can but need not include sealing contact or engagement.

With continuing reference to the Figures and particular reference to FIGS. 8-9, in at least one embodiment, choke 100 can optionally include one or more additional closures 400, such as secondary, supplemental or other closures, for at least partially supporting sealing engagement between seat 200 and gate 300 or one or more portions thereof, such as one or more portions of seat profile 208 and gate profile 308. One or more closures 400 can be said to be supplemental or secondary in the sense that they function alongside one or more other portions of choke profiles 208, 308 (e.g., sealing profile sections 208*a*, 308*d*), but one or more closures 400 can, in at least one embodiment, be or be part of a primary closure in the sense of providing the first or initial sealing engagement among a seat 200 and a gate 300 upon reaching or approaching a fully closed position according to an implementation of the disclosure.

In at least one embodiment, closure 400 can be or include a tongue and groove closure comprising one or more tongues 402 for sealing engagement with one or more mating or otherwise corresponding grooves 404. One or more tongues 402 can be coupled to seat 200 or a portion thereof (e.g., sealing section 208*a*) and one or more grooves 404 can be coupled to gate 300 or a portion thereof (e.g., sealing section 308*d*). One or more tongues 402 can be coupled to gate 300 or a portion thereof (e.g., sealing section 308*d*) and one or more grooves 404 can be coupled to seat 200 or a portion thereof (e.g., sealing section 208*a*). Any of seat 200 and gate 300 can include any number of tongues 402 and/or grooves 404 according to an implementation of the disclosure. As shown in the exemplary embodiment of FIGS. 8-9 for illustrative purposes, which embodiment is but one of many, one or more tongues 402 and grooves 404 can be semi-circular in shape and can be disposed on or in mating sealing sections of profiles 208, 308, such as, for example, sealing sections 208*a* and 308*d*. However, this need not be the case and alternatively, or collectively, one or more tongues 402 and grooves 404 can be any shape required or desired for an implementation of the disclosure, whether curved, linear, or otherwise, in whole or in part, and can be disposed on any section or sections of profiles 208, 308 configured for sealing engagement with one another in one or more positions (which can but need not include a portion of one or more choke sections). In at least one embodiment, closure 400 can be or include one or more additional sealing surfaces distinct from one or more other sealing surfaces or sections of seat 200 and gate 300 (e.g., along profiles 208, 308), and/or can at least partially separate or divide a single sealing surface into a plurality of sealing surfaces, which can at least partially minimize erosion of one or more sealing surfaces and/or provide supplemental sealing surfaces or redundancy for extending choke service life by supporting continued sealing capabilities even in the presence of erosion of one or more other sealing surfaces. Tongues 402 and/or grooves 404 can be formed in any manner according to an implementation of the disclosure, such as by machining, welding, or otherwise, and can be formed integrally or separately with one or more other choke components, in whole or in part. Tongues 402 and/or grooves 404 can be formed from any material according to an implementation of the invention, including, e.g., steel, tungsten carbide, or cobalt tungsten carbide, in whole or in part.

Choke 100 and the components thereof, such as seat 200 and gate 300, can be or be adapted for use with or in any type or size of oilwell choke or fluid control system according to an implementation of the disclosure. For instance, choke 100 can have an orifice size of 1.5 inches, 2 inches, or less or more, such as from at least about 0.5 inch to at least about 10 inches (e.g., from 1.5 inches to 6 inches), depending on a real world implementation at hand and relevant factors such as pressures, fluid types, flow volumes, flow rates and/or other characteristics or variables associated with such an implementation. The shapes, sizes and dimensions of one or more choke components according to the disclosure can, but need not, vary among two or more embodiments accordingly. The orifice sizes mentioned above are by way of example only and other orifice sizes for chokes 100 according to the disclosure are possible.

For example, in at least one embodiment, choke 100 can have an orifice size of 2 inches. In such an embodiment, which is but one of many, seat 200 can have a length of 2 inches, an outside diameter of 3.25 inches and an inside minor diameter of 2 inches. Mouth angle A1 of section 208*a* can be 45 degrees, second section 208*a* can have a radius R1 of 1 inch and third section 208*c* can have a radius R2 of 3.625 inches. Radius R1 can have a center 0.575 inch from a plane through a terminal end of seat 200 and Radius R2 can have a center 1 inch from a plane through a terminal end of seat 200. In such an embodiment, which is but one of many, gate 300 can have a length of 5 inches, an outside diameter of 2.5 inches and an inside minor diameter of 0.585 inches. Nose angle A2 of section 308*a* can be 5 degrees, second section 308*a* can have a radius R3 of 3.625 inches and third section 308*c* can have a radius R4 of 1 inch. Radius R3 can have a center 0.125 inch from a plane through a terminal end of gate 300 and Radius R4 can have a center 0.550 inch from a plane through a terminal end of gate 300. Base angle A3 of fourth section 308*d* can be 45 degrees. Any of the aforementioned values can, but need not be, exact and can be subject to tolerances or variances according to an implementation. The foregoing embodiment is described herein for illustrative purposes and is but one of many advantageous real world implementations of the present disclosure. Many other shapes and sizes of choke 100, seat 200 and gate 300 are possible.

In at least one embodiment, seat 200 can include a radius R1 less than, greater than, or equal to radius R2. In at least one embodiment, radius R2 of seat 200 can be a multiple of radius R1, such as by way of having a value 2 times, 2.5 times, 3 times, 3.5 times, 3.625 times, or another multiple of a value of radius R1. In at least one embodiment, radius R4 of gate 300 can be a multiple of radius R3, such as by way of having a value 2 times, 2.5 times, 3 times, 3.5 times, 3.625 times, or another multiple of a value of radius R3. In at least one embodiment, one or more of mouth angle A1 of section 208*a* and base angle A3 of fourth section 308*d* (or one or more portions thereof) can be disposed at an angle other than 45 degrees, such as from 35 degrees to 55 degrees or another angle according to an implementation of the disclosure. In at least one embodiment, mouth angle A1 of section 208*a* and base angle A3 of fourth section 308*d* (or one or more portions thereof) can at least partially differ from one another, which in at least some cases can help concentrate the contact sealing pressure to a smaller area thus improving sealing characteristics. For instance, in at least one embodiment, mouth angle A1 of section 208*a* and base angle A3 of fourth section 308*d* (or one or more portions thereof) can differ by at least about 1 to 1.5 degrees or by at least about 0.5 to 2 degrees. In such an embodiment, which is but one of many, one of seat 200 and gate 300 can have a sealing section or portion at an angle of, e.g., 45 degrees (or another angle), and the other of seat 200 and gate 300 can have a sealing section or portion at an angle that differs by at least about 1 to 1.5 degrees or by at least about 0.5 to 2 degrees.

With continuing reference to the Figures and particular reference to FIGS. 10A-10F, a choke 100 having a seat profile 208 and gate profile 308 according to the disclosure can advantageously provide for more precise flow metering and control versus conventional oil well chokes and can also provide for increased wear resistance, for example, due to the relatively larger surface area of the choke profiles exposed to fluid flow during choke operations. As illustrated by the exemplary choke positions of FIGS. 10A-10F, which show flow profiles of a choke 100 according to the disclosure on the left half and flow profiles of a conventional choke 10 on the right half, the flow area and rate of change of flow area for choke 100 during opening and closing as well as in one or more partially open (or partially closed) positions are superior to that of a conventional choke 10 including because choke 100 provides for more controllable flow under choked flow conditions and because the flow area of choke 100 increases and decreases at a more constant rate (i.e., providing for a more linear flow coefficient (Cv) curve and Cv response) during opening and closing, respectively.

Such advantages are further illustrated by the flow area comparison of Table 1 below. More specifically, Table 1 presents exemplary flow area data (in square inches) from a comparison of choke 100 and a conventional choke 10 for a 1.5 inch diameter orifice over a range of choke positions from 0% open (i.e., closed) to 100% open. As will be understood by a person of ordinary skill in the art having the benefits of the present disclosure, a 1.5 inch orifice is a common size in the field and comprises a maximum flow area of 1.7671 square inches ($in^2$) through the orifice. As seen upon a comparison of the flow areas in column 2 for choke 100 and the flow areas in column 3 for conventional choke 10, conventional choke 10 has a flat Cv during the first approximately 20% of opening and then jumps open at approximately 25% of opening. Conventional choke 10 exhibits similar behavior at approximately 60% of opening and jumps to the maximum flow area at approximately 70% opening. To the contrary, choke 100 advantageously exhibits a more constant change in flow area throughout approximately 80% of opening, thus providing improved controllability and response during choke operations including during the often important or even crucial initial opening/near closed choke operation positions. Of course, the data presented in Table 1 is presented for purposes of explanation and illustration and the particular data reflected in the table relates to but one of many possible embodiments and sizes of choke 100. Similar advantages can be obtained by way of other sizes and embodiments of choke 100.

TABLE 1

| Flow Area Comparison | | | | |
|---|---|---|---|---|
| % Open | Choke 100 Flow Area ($in^2$) | Conventional Choke 10 Flow Area ($in^2$) | % Difference | Bean Size (64ths of an inch) |
| 0 | 0.0071 | 0.0071 | 0 | 5.4 |
| 5 | 0.0122 | 0.0071 | 172 | 8 |
| 10 | 0.0283 | 0.0071 | 400 | 12 |
| 15 | 0.055 | 0.0071 | 775 | 17 |
| 20 | 0.0934 | 0.0071 | 1315 | 22 |
| 25 | 0.1295 | 0.0283 | 458 | 26 |
| 30 | 0.1842 | 0.141 | 30 | 31 |
| 35 | 0.2485 | 0.2576 | −4 | 36 |
| 40 | 0.3364 | 0.3771 | −12 | 42 |
| 45 | 0.4429 | 0.5006 | −13 | 48 |
| 50 | 0.5802 | 0.6271 | −8 | 55 |
| 60 | 0.9875 | 1.0306 | −4 | 72 |
| 70 | 1.6989 | 1.7671 | −4 | 94 |
| 80 | 1.7671 | 1.7671 | 0 | 96 |
| 75 | 1.7671 | 1.7671 | 0 | 96 |
| 100 | 1.7671 | 1.7671 | 0 | 96 |

In at least one embodiment, a choke, or choke valve, for an oil and/or gas well can include a body having one or more inlets for allowing fluid flow into the choke body and one or more outlets for allowing fluid flow out of the choke body, and one or more tubular or other seats disposed within the choke body fluidically between an inlet and an outlet. A seat can have an upstream end fluidically upstream from a downstream end, a radially interior surface and a radially exterior surface. A gate can be disposed at least partially within a choke body and can have a first or other end with a radially exterior surface and a second or other end longitudinally opposite the first or other end. A radially interior surface of a seat can include a first or other seat profile, such as from an upstream end of the seat to a midpoint of a flow path through or otherwise along the seat, and a second or other seat profile, such as from a midpoint of a flow path to a downstream or other end of the seat. A radially exterior surface of a first or other end of the gate can include a first or other gate profile. A gate or a portion thereof can be configured to optionally sealingly engage a seat or a portion thereof. One or more seat and gate profiles or portions thereof can be at least partially curved.

In at least one embodiment, a curved portion of a seat profile and a curved portion of a gate profile can be configured to sealingly couple when the choke is in one or more positions, such as a fully closed position. A first or other seat profile can have a first curved section with a first radius of curvature and a second curved section with a second radius of curvature. A first radius of curvature and a second radius of curvature can be the same or different. A first or other curved section can be fluidically upstream of a second or other curved section. A first or other radius of curvature can be less than, greater than, or equal to, a second or other radius of curvature. In at least one embodiment, an upstream end or other portion of a seat can include a mouth and a first or other seat profile can include a mouth section fluidically upstream of a first or other curved section. A mouth section can extend radially outwardly from a first or other curved section at one or more angles, such as, for example, an angle of 45 degrees relative to a longitudinal center line of the seat. In at least one embodiment, at least a portion of one or more profiles, such as first, second or other seat or gate profiles, can be elliptical.

In at least one embodiment, a first or other curved section can have a fluidically upstream-most end with a first inside diameter and a second curved section can have a fluidically downstream-most end with a second inside diameter, such as at a midpoint or other point of a flow path through a seat. A second inside diameter can be less than a first inside diameter. In at least one embodiment, first and second curved sections can have a constantly changing slope from one reference point or location to another, such as from an upstream-most end of a first curved section to a downstream-most end of a second curved section. In at least one embodiment, a second seat profile can be a mirror image of a first seat profile, such as about a plane bisecting a seat through a midpoint or other point of a flow path.

In at least one embodiment, a first gate profile can have a first curved section with a first radius of curvature and a second curved section with a second radius of curvature. A first radius of curvature and a second radius of curvature can be the same or different. A first curved section can be fluidically downstream from a second curved section and a first radius of curvature can be greater than a second radius of curvature. A first end of a gate can include a nose and a first gate profile can include a nose section fluidically downstream from a first curved section. A nose section can extend radially inwardly from a first or other curved section at one or more angles, such as an angle of 5 degrees relative to a longitudinal center line of a gate. A first end of a gate can include a base and a first gate profile can include a base section fluidically upstream of a second curved section. A base section can extend radially outwardly from a second curved section at one or more angles, such as an angle of 45 degrees relative to a longitudinal center line of a gate. In at least one embodiment, at least a portion of one or more gate profiles can be elliptical.

In at least one embodiment, a first or other curved section can have a fluidically downstream-most end with a first outside diameter and a second or other curved section can have a fluidically upstream-most end with a second outside diameter. A second outside diameter can be greater than a first outside diameter. In at least one embodiment, first and second or other curved sections can have a constantly changing slope over or along at least a portion thereof, such as from a downstream-most end of a first curved section to an upstream-most end of a second curved section. A first gate profile can have a first curved section with a first radius of curvature and a second curved section with a second radius of curvature. A first curved section of a first gate profile can be fluidically downstream from a second curved section of a first gate profile. A first end of a gate can include a base and a first gate profile can include a base section fluidically upstream of a second curved section of a first gate profile. A base section can extend radially outwardly from a second curved section of a first gate profile at one or more angles, such as an angle of 45 degrees relative to a longitudinal center line of the gate.

In at least one embodiment, a choke can include one or more closures or seals, such as first, second, primary, secondary, or other closing structures. In at least one embodiment, a secondary or other closure can include one or more tongues configured to sealingly engage one or more grooves, such as, for example, an annular semicircular tongue configured to sealingly engage an annular semicircular groove. At least one of a tongue and a groove can be disposed on a gate and a seat. For example, one or more of a tongue and a groove can be disposed on a mouth section or other portion of a seat profile and one or more of the other of a tongue and a groove can be disposed on a base section or other portion of a gate profile.

In at least one embodiment, a choke for an oil and/or gas well can include a choke body having an inlet for allowing fluid flow into the choke body and an outlet for allowing fluid flow out of the choke body, a tubular seat disposed within the choke body fluidically between the inlet and the outlet, the seat having an upstream end fluidically upstream from a downstream end, a radially interior surface and a radially exterior surface, and a gate disposed at least partially within the choke body, the gate having a first end with a radially exterior surface and a second end longitudinally opposite the first end. A radially interior surface of the seat can include a first seat profile from the upstream end of the seat to a midpoint of a flow path through the seat and a second seat profile from the midpoint of the flow path to the downstream end of the seat. A radially exterior surface of the first end of the gate can include a first gate profile. A seat profile can have a first curved section with a first radius of curvature fluidically upstream of a second curved section with a second radius of curvature. A gate profile can have a first curved section with a first radius of curvature fluidically downstream from a second curved section with a second radius of curvature. A first curved section of a seat profile can be configured to at least partially engage a second curved section of a gate profile. A second curved section of a seat profile can be configured to at least partially engage a first curved section of a gate profile, such as when a choke is in a fully closed position or one or more other positions.

In at least one embodiment, an upstream end of a seat can include a mouth and a first seat profile can include a mouth section fluidically upstream of a first or other curved section. A mouth section can extend radially outwardly from a first curved section of a first seat profile at one or more angles. A first end of a gate can include a base and a first gate profile can include a base section fluidically upstream of a second curved section. A base section can extend radially outwardly from a second curved section of a first gate profile at one or more angles. A mouth section can be configured to at least partially engage a base section, or vice versa, when the choke is in one or more positions, such as a fully closed position or one or more other positions. In at least one embodiment, a choke can include a secondary or other closure comprising a tongue and groove configured to at least partially engage one another. For example, in at least one embodiment, a choke can include an annular semicircular tongue configured to sealingly engage an annular semicircular groove. One of the tongue and the groove can be disposed on a seat profile and the other of the tongue and the groove can be disposed on a gate profile. One or more tongues and/or grooves can be disposed on a seat and/or gate.

In the aforementioned manners, one or more embodiments of the disclosure can be or include improved oilwell chokes and choke systems having greater rangeability and having greater flow and pressure adjustability and controllability, including upon initial opening of the choke or in other near-closed positions. One or more embodiments of the disclosure can have an improved flow curve, such as a more linear flow curve, which can include in comparison to an opening distance between a gate and seat. One or more embodiments of the disclosure can have an improved Cv over conventional chokes, such as by way of distributing flow over relatively smoother flow surfaces or decreasing pressure drop across the choke. One or more embodiments of the disclosure can provide for increased erosion resistance in one or more portions or areas of a choke profile or sealing surface, which can include having one or more supplemental or redundant closures.

Other and further embodiments utilizing one or more aspects of the devices, systems and methods described above can be devised without departing from the spirit of the present disclosure. For example, the devices, systems and methods disclosed herein can be used alone or to form one or more parts of other chokes, choke components and/or fluid control systems comprising one or more chokes. Further, the various methods and embodiments of the chokes and choke components can be included in combination with each other to produce variations of the disclosed methods and embodiments. In addition, while embodiments of the disclosure generally have been described in the context of being utilized to perform a choke function (e.g., with fluid flow F in the direction indicated by the arrows in FIG. 2), this need not be the case and in at least one embodiment choke 100 can be utilized as a relief valve, which can include fluid flow in the direction opposite that indicated in FIG. 2. More specifically, in at least one embodiment, choke 100 can be configured for use as a pressure (or flow) relief valve for an oil well, which can include being configured for fluid flow into outlet 106 and out of inlet 104. In such an embodiment, pressure build up on the upstream side of orifice 110 (e.g., on a horizontal surface or face of gate 300) can be sensed by one or more sensors and can signal a control system to open or otherwise prompt opening of choke 100 to relieve pressure as may be needed or desired according to an implementation of the disclosure. Utilization of choke 100 in this manner can be useful, for example, in the context of managed pressure drilling (MPD) wherein downhole or other operations may be performed with pressure in the wellbore. The features and advantages of choke 100 described elsewhere herein can hold true in such an embodiment, for instance, because the curved surfaces of the gate and seat according to the disclosure provide improved wear resistance (and pressure control) versus conventional flow relief valves owing to the relatively larger surface areas exposed to the flow path through choke 100.

Unless the context requires otherwise, the words "comprise," "include," and "has" (including variations and conjugations thereof, such as "comprises," "including," "have" and so forth) should be understood to imply the inclusion of at least the stated element or step or group of elements or steps or equivalents thereof, and not the exclusion of a greater numerical quantity or any other element or step or group of elements or steps or equivalents thereof. The devices, apparatuses and systems can be used in a number of directions and orientations. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components and/or can be combined into components having multiple functions. Discussion of singular elements can include plural elements and vice-versa. References to at least one item followed by a reference to the item can include one or more items. Also, various aspects of the embodiments can be used in conjunction with each other to accomplish the goals of the disclosure. The term "fluid(s)" as used herein includes any substance or material capable of flowing, such as, for example, liquid(s), gas(es) and combinations thereof (regardless of whether one or more solids or other non-fluids may be present therein).

The embodiments have been described in the context of preferred and other embodiments and not every embodiment of Applicant's disclosure has been described. Obvious modifications and alterations to the described embodiments are available to those of ordinary skill in the art having the benefits of the present disclosure. The disclosed and undisclosed embodiments are not intended to limit or restrict the scope or applicability of Applicant's disclosures, but rather, in conformity with the patent laws, Applicant intends to fully protect all such modifications and improvements that come within the scope or range of equivalents of the claims.

What is claimed is:

1. A choke for an oil and/or gas well, comprising:

a choke body having an inlet for allowing fluid flow into the choke body and an outlet for allowing fluid flow out of the choke body;

a tubular seat disposed within the choke body fluidically between the inlet and the outlet, the seat having an upstream end fluidically upstream from a downstream end, a radially interior surface and a radially exterior surface; and a gate disposed at least partially within the choke body, the gate having a first end with a radially exterior surface and a second end longitudinally opposite the first end;

wherein the radially interior surface of the seat comprises a first seat profile from the upstream end of the seat to a midpoint of a flow path through the seat and a second seat profile from the midpoint of the flow path to the downstream end of the seat, wherein at least the first seat profile comprises a sealing section and a choke section;

wherein the radially exterior surface of the first end of the gate comprises a first gate profile having a sealing section and a choke section;

wherein the sealing section of the first seat profile and the sealing section of the first gate profile are configured to sealingly engage one another for preventing fluid flow through the choke;

wherein the choke sections of the first seat profile and the first gate profile are at least partially curved; and wherein the choke section of the first seat profile has a first curved section with a first radius of curvature and a second curved section with a second radius of curvature.

2. The choke of claim 1, wherein a curved portion of the choke section of the first seat profile and a curved portion of the choke section of the first gate profile are configured to restrict and direct fluid flow through the choke when the choke is in an at least partially open position.

3. The choke of claim 1, wherein the first radius of curvature and the second radius of curvature are different.

4. The choke of claim 1, wherein the first curved section is fluidically upstream of the second curved section and wherein the first radius of curvature is less than the second radius of curvature.

5. The choke of claim 4, wherein the upstream end of the seat comprises a mouth and the sealing section of the first seat profile comprises a mouth section fluidically upstream of the first curved section, and wherein the mouth section extends radially outwardly from the first curved section at an angle relative to a longitudinal center line of the seat.

6. The choke of claim 1, wherein at least a portion of the choke section of the first seat profile is elliptical.

7. The choke of claim 4, wherein the first curved section has a fluidically upstream-most end with a first inside diameter and the second curved section has a fluidically downstream-most end with a second inside diameter at the midpoint of the flow path through the seat, wherein the second inside diameter is less than the first inside diameter, and wherein the first and second curved sections have a constantly changing slope from the upstream-most end of the first curved section to the downstream-most end of the second curved section.

8. The choke of claim 3, wherein the second seat profile is a mirror image of the first seat profile about a plane bisecting the seat through the midpoint of the flow path.

9. The choke of claim 1, wherein the choke section of the first gate profile has a first curved section with a first radius of curvature and a second curved section with a second radius of curvature.

10. The choke of claim 9, wherein the first radius of curvature of the first gate profile and the second radius of curvature of the first gate profile are different.

11. The choke of claim 9, wherein the first curved section of the first gate profile is fluidically downstream from the second curved section of the first gate profile and wherein the first radius of curvature of the first gate profile is greater than the second radius of curvature of the first gate profile.

12. The choke of claim 11, wherein the first end of the gate comprises a nose and the first gate profile comprises a nose section fluidically downstream from the first curved section of the first date profile, and wherein the nose section extends radially inwardly from the first curved section of the first date profile at an angle relative to a longitudinal center line of the gate.

13. The choke of claim 11, wherein the first end of the gate comprises a base and the sealing section of the first gate profile comprises a base section fluidically upstream of the second curved section of the first gate profile, and wherein the base section extends radially outwardly from the second curved section of the first gate profile at an angle of 45 degrees relative to a longitudinal center line of the gate.

14. The choke of claim 9, wherein at least a portion of the choke section of the first gate profile is elliptical.

15. The choke of claim 11, wherein the first curved section of the first gate profile has a fluidically downstream-most end with a first outside diameter and the second curved section of the first gate profile has a fluidically upstream-most end with a second outside diameter, wherein the second outside diameter is greater than the first outside diameter, and wherein each of the first and second curved sections of the first gate profile has a constantly changing slope from the downstream-most end of the first curved section of the first gate profile to the upstream-most end of the second curved section of the first gate profile.

16. The choke of claim 5, wherein the choke section of the first gate profile has a first curved section with a first radius of curvature and a second curved section with a second radius of curvature;

wherein the first curved section of the first gate profile is fluidically downstream from the second curved section of the first gate profile;

wherein the first end of the gate comprises a base and the sealing section of first gate profile comprises a base section fluidically upstream of the second curved section of the first gate profile;

wherein the base section extends radially outwardly from the second curved section of the first gate profile at an angle relative to a longitudinal center line of the gate;

wherein the choke comprises a secondary closure comprising an annular tongue configured to sealingly engage an annular groove; and wherein one of the tongue and the groove is disposed on the mouth section of the first seat profile and the other of the tongue and the groove is disposed on the base section of the first gate profile.

17. A choke for an oil and/or gas well, comprising:

a choke body having an inlet for allowing fluid flow into the choke body and an outlet for allowing fluid flow out of the choke body;

a tubular seat disposed within the choke body fluidically between the inlet and the outlet, the seat having an upstream end fluidically upstream from a downstream end, a radially interior surface and a radially exterior surface; and a gate disposed at least partially within the choke body, the gate having a first end with a radially exterior surface and a second end longitudinally opposite the first end;

wherein the radially interior surface of the seat comprises a first seat profile from the upstream end of the seat to a midpoint of a flow path through the seat and a second seat profile from the midpoint of the flow path to the downstream end of the seat, wherein at least the first seat profile comprises a sealing section and a choke section;

wherein the radially exterior surface of the first end of the gate comprises a first gate profile having a sealing section and a choke section;

wherein the choke section of the first seat profile has a first curved section with a first radius of curvature fluidically upstream of a second curved section with a second radius of curvature;

wherein the choke section of the first gate profile has a first curved section with a first radius of curvature fluidically downstream from a second curved section with a second radius of curvature;

wherein the sealing section of the first seat profile and the sealing section of the first gate profile are configured to sealingly engage one another when the choke is in a fully closed position; and wherein the choke section of the first seat profile and the choke section of the first gate profile are configured to restrict and direct fluid flow through the choke when the choke is in an at least partially open position.

18. The choke of claim 17, wherein the upstream end of the seat comprises a mouth and the sealing section of the first seat profile comprises a mouth section fluidically upstream of its choke section;

wherein the mouth section extends radially outwardly from the choke section of the first seat profile at an angle;

wherein the first end of the gate comprises a base and the sealing section of the first gate profile comprises a base section fluidically upstream of its choke section;

wherein the base section extends radially outwardly from the choke section of the first gate profile at an angle; and wherein the mouth section is configured to at least partially engage the base section when the choke is in the fully closed position.

19. The choke of claim 18, wherein the choke comprises a secondary closure comprising an annular tongue configured to sealingly engage an annular groove; and wherein one of the tongue and the groove is disposed on the mouth section of the first seat profile and the other of the tongue and the groove is disposed on the base section of the first gate profile.

20. A choke for an oil and/or gas well, comprising:

a choke body having an inlet for allowing fluid flow into the choke body and an outlet for allowing fluid flow out of the choke body;

a tubular seat disposed within the choke body fluidically between the inlet and the outlet, the seat having an upstream end fluidically upstream from a downstream end, a radially interior surface and a radially exterior surface; and a gate disposed at least partially within the choke body, the gate having a first end with a radially exterior surface and a second end longitudinally opposite the first end;

wherein the radially interior surface of the seat comprises a first seat profile from the upstream end of the seat to a midpoint of a flow path through the seat and a second seat profile from the midpoint of the flow path to the downstream end of the seat, wherein at least the first seat profile comprises a sealing section and a choke section;

wherein the radially exterior surface of the first end of the gate comprises a first gate profile having a sealing section and a choke section;

wherein the sealing section of the first seat profile and the sealing section of the first gate profile are configured to sealingly engage one another for preventing fluid flow through the choke;

wherein the choke sections of the first seat profile and the first gate profile are at least partially curved;

wherein the choke section of the first gate profile has a first curved section with a first radius of curvature and a second curved section with a second radius of curvature; and wherein the first curved section is fluidically downstream from the second curved section and wherein the first radius of curvature is greater than the second radius of curvature.

* * * * *